US005211615A

United States Patent [19]

Sides

[11] Patent Number: 5,211,615

[45] Date of Patent: May 18, 1993

[54] WEIGHT LIFTING HARNESS APPARATUS

[76] Inventor: Charles H. Sides, 920 Mohawk, Apt. 41, Savannah, Ga. 31419

[21] Appl. No.: 835,519

[22] Filed: Feb. 14, 1992

[51] Int. Cl.[5] ..... A63B 21/12

[52] U.S. Cl. ..... 482/105; 482/106; 482/148

[58] Field of Search ..... 273/73 J, 75, 14, 17, 273/67 DA, 67 DB, 81 R, 66, 81.2; 482/105, 106; 224/265

[56] References Cited

U.S. PATENT DOCUMENTS

| | | | |
|---|---|---|---|
| 1,563,352 | 12/1925 | Fisher | 273/73 J |
| 2,746,369 | 5/1956 | Beard | 224/265 |
| 3,679,107 | 7/1972 | Perring | 482/106 |
| 4,139,132 | 2/1979 | Fairchild | 224/265 |
| 4,139,195 | 2/1979 | Dressen et al. | 273/75 |
| 4,213,605 | 7/1980 | McPeak | 482/105 |
| 4,213,609 | 7/1980 | Swanson | 273/75 |

*Primary Examiner*—Richard J. Apley

*Assistant Examiner*—Jerome Donnelly

*Attorney, Agent, or Firm*—Leon Gilden

[57] ABSTRACT

An apparatus including a torso plate to include a plurality of rigid arcuate first and second shoulder straps are mounted and extend from a top edge of the plate to define respective first and second shoulder receiving cavities, with each respective plate terminating in a respective first and second handle. The first and second arcuate plates include first and second abutment flanges projecting therefrom, wherein the abutment flanges are of a predetermined length greater than a predetermined diameter defined by a weight lifting bar to permit positioning of the bar within spaced pairs of flanges in support of the bar during a weight lifting "squat" procedure utilizing "free weight". A modification of the invention includes securable pad members mounted within bottom surfaces of each of the first and second arcuate plates and to further include rods and dispensing handles to enhance and insure grip during use of the organization.

4 Claims, 4 Drawing Sheets

WEIGHT LIFTING HARNESS APPARATUS

BACKGROUND OF THE INVENTION

1. Field of the Invention

The field of invention relates to exercise apparatus, and more particularly pertains to a new and improved weight lifting harness apparatus to arrange for the support and alignment of a weight lifting bar during a free weight squat procedure.

2. Description of the prior Art

A squat performed in a weight lifting procedure requires the positioning of a weight lifting bar mounted across the rear or forward portions of an individual's shoulders. Slippage and various physiological limitations of individuals prohibit individuals from effecting a squat exercise to a full potential relative to that individual. The instant invention attempts to overcome deficiencies of the prior art by providing a harness arranged to permit the proper alignment positioning of a weight lifting bar during a squat or leg press.

The prior art has heretofore failed to address the proper positioning of a weight lifting bar and weight lifting apparatus in garments and have heretofore not provided the support as required by the instant invention and the exercise of a leg press or squat. U.S. Pat. No. 4,800,593 to Ruffner sets forth a protective garment for weight lifters that employs various padding and the like for support of weight lifting bars thereon.

Accordingly, it may be appreciated that there continues to be a need for a new and improved weight lifting harness apparatus as set forth by the instant invention which addresses both the problems of ease of use as well as effectiveness in construction and this respect, the present invention substantially fulfills this need.

SUMMARY OF THE INVENTION

In view of the foregoing disadvantages inherent in the known types of weight lifting apparatus now present in the prior art, the present invention provides a weight lifting harness apparatus wherein the same includes a plurality of arcuate straps mounted to a torso support plate, with the straps each including abutment flanges for supporting the weight lifting bar orthogonally relative to the straps. As such, the general purpose of the present invention, which will be described subsequently in greater detail, is to provide a new and improved weight lifting harness apparatus which has all the advantages of the prior art weight lifting apparatus and none of the disadvantages.

To attain this, the present invention provides an apparatus including a torso plate to include a plurality of rigid arcuate first and second shoulder straps mounted and extending from a top edge of the plate to define respective first and second shoulder receiving cavities, with each respective plate terminating in a respective first and second handle. The first and second arcuate plates include first and second abutment flanges projecting therefrom, wherein the abutment flanges are of a predetermined length greater than a predetermined diameter defined by a weight lifting bar to permit positioning of the bar within spaced pairs of flanges in support of the bar during a weight lifting "squat" procedure utilizing "free weight". A modification of the invention includes securable pad members mounted within bottom surfaces of each of the first and second arcuate plates and to further include rods and dispensing handles to enhance and insure grip during use of the organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved weight lifting harness apparatus which has all the advantages of the prior art weight lifting apparatus and none of the disadvantages.

It is another object of the present invention to provide a new and improved weight lifting harness apparatus which may be easily and efficiently manufactured and marketed.

It is a further object of the present invention to provide a new and improved weight lifting harness apparatus which is of a durable and reliable construction.

An even further object of the present invention is to provide a new and improved weight lifting harness apparatus which is susceptible of a low cost of manufacture with regard to both materials and labor, and which accordingly is then susceptible of low prices of sale to the consuming public, thereby making such weight lifting harness apparatus economically available to the buying public.

Still yet another object of the present invention is to provide a new and improved weight lifting harness apparatus which provides in the apparatuses and methods of the prior art some of the advantages thereof, while simultaneously overcoming some of the disadvantages normally associated therewith.

These together with other objects of the invention, along With the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
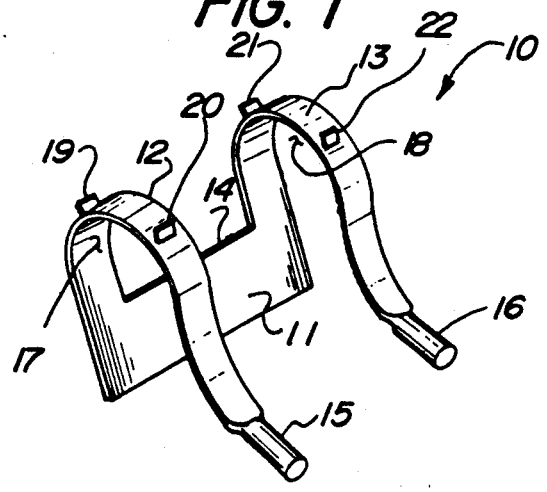
FIG. 1 is an isometric illustration of the instant invention.

With reference now to the drawings, and in particular to FIGS. 1 to 12 thereof, a new and improved weight lifting harness apparatus embodying the principles and concepts of the present invention and generally designated by the reference numeral 10 will be described.

Figure 2:
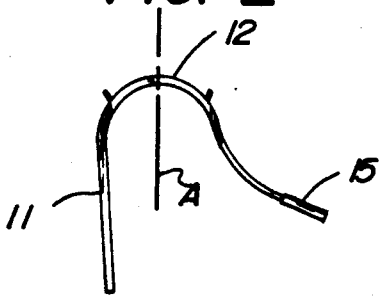
FIG. 2 is an orthographic side view of the instant invention.
Figure 3:
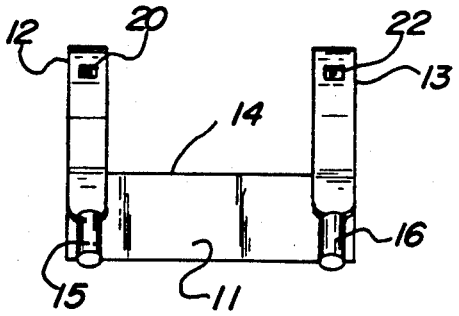
FIG. 3 is an orthographic frontal view of the invention taken in elevation.
Figure 4:
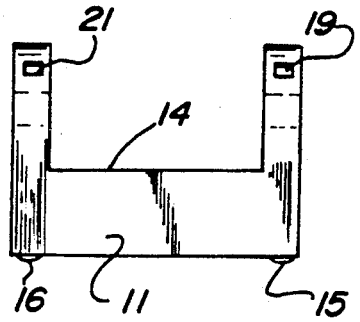
FIG. 4 is an orthographic rear view of the invention taken in elevation.
Figure 5:
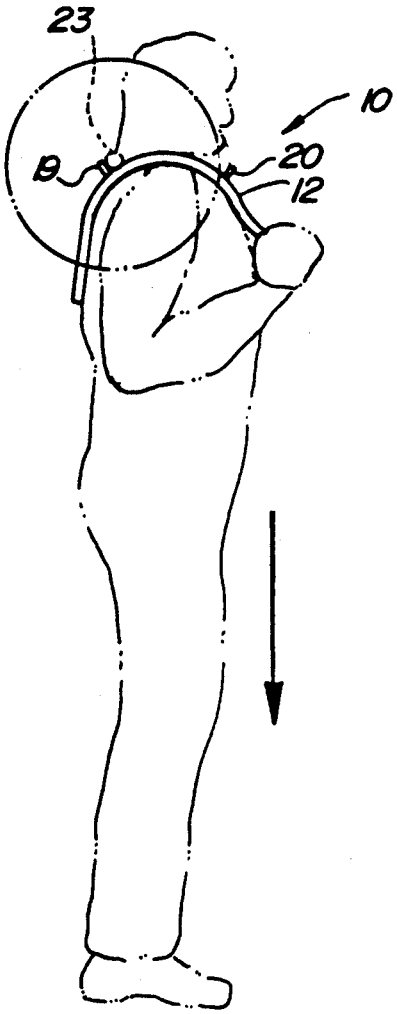
FIG. 5 is an orthographic side view of the apparatus utilizing a weight lifting bar positioned in a first orientation relative to the apparatus.
Figure 6:
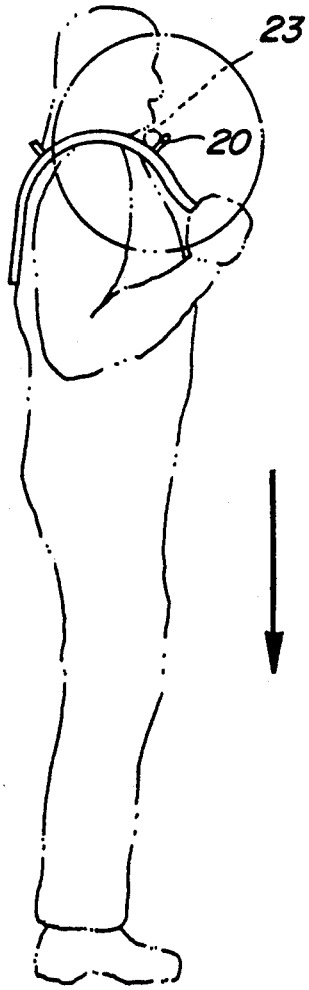
FIG. 6 is an orthographic side view of the invention illustrating employment of the invention with the weight lifting bar mounted to a forward portion of the apparatus.

More specifically, the weight lifting harness apparatus 10 of the instant invention essentially comprises a first plate member 11, including a rigid first arcuate shoulder plate spaced from, parallel to, and coextensive with a rigid second arcuate shoulder plate 13 of identical configuration mounted to opposed ends of the support plate top edge 14. The top edge 14 is spaced from a support plate bottom edge 14*a*. The respective first and second plates 12 and 13 terminate in respective first and second handles 15 and 16 that project forwardly of the support plate and extend to a spaced relationship substantially aligned with the support plate bottom edge 14*a*. The first and second shoulder plates 12 and 13 define respective first and second shoulder receiving cavities 17 and 18 relative to bottom surfaces of the respective first and second shoulder plates. The first shoulder plate includes a first shoulder plate respective first and second abutment flange 19 and 20 projecting upwardly relative to a top surface of the first plate on opposed sides of an axial center line of the respective first and second cavity 17 and 18 of a generally semicylindrical configuration. The axial center line, as illustrated in FIG. 2, is represented as the designation A. The second should plate includes second shoulder plate first and second abutment flanges 21 and 22 positioned an equal distance relative to the axial center line A to a top surface of the second shoulder plate on opposed sides of the axial center line. The abutment flanges 19-22 are each defined by a predetermined length greater than a predetermined diameter of an associated weight lifting bar 23 see FIGS. 5 and 6) mounted to a top surface of the first and second shoulder plates in abutment relative to the first flanges or the second flanges respectively.

Figure 7:
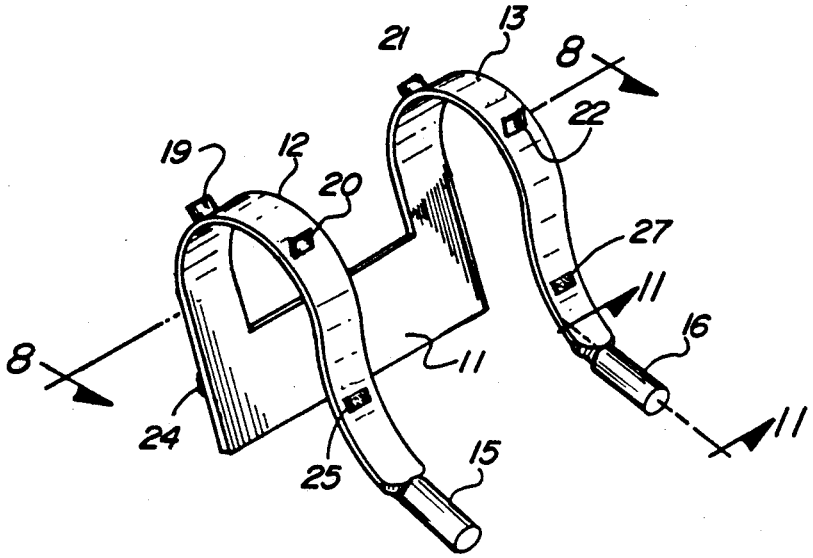
FIG. 7 is an isometric illustration of a further aspect of the invention.
Figure 8:
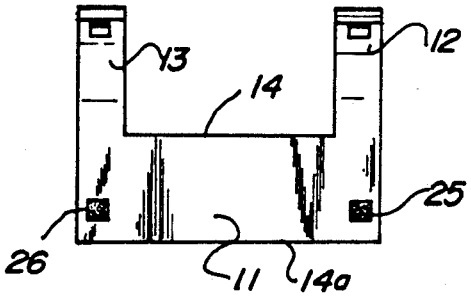
FIG. 8 is an orthographic view, taken along the lines 8—8 of FIG. 7 in the direction indicated by the arrows.
Figure 9:
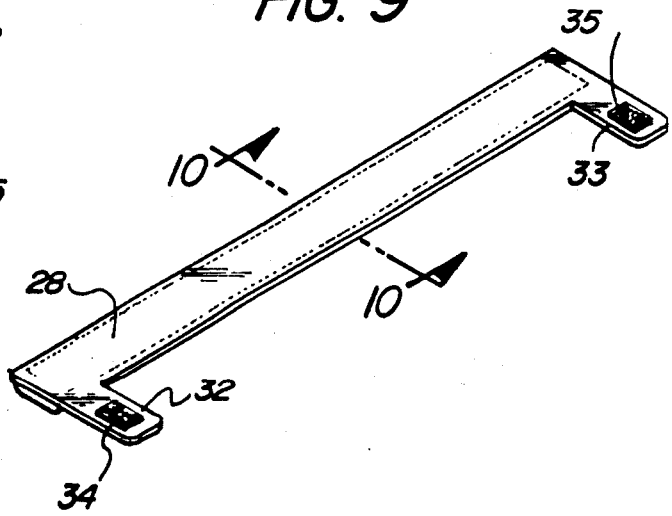
FIG. 9 is an isometric illustration of one of a plurality of cushion straps utilized by the invention.
Figure 10:
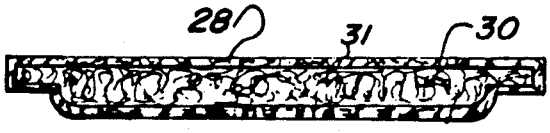
FIG. 10 is an orthographic view, taken along the lines 10—10 of FIG. 9 in the direction indicated by the arrows.
Figure 11:
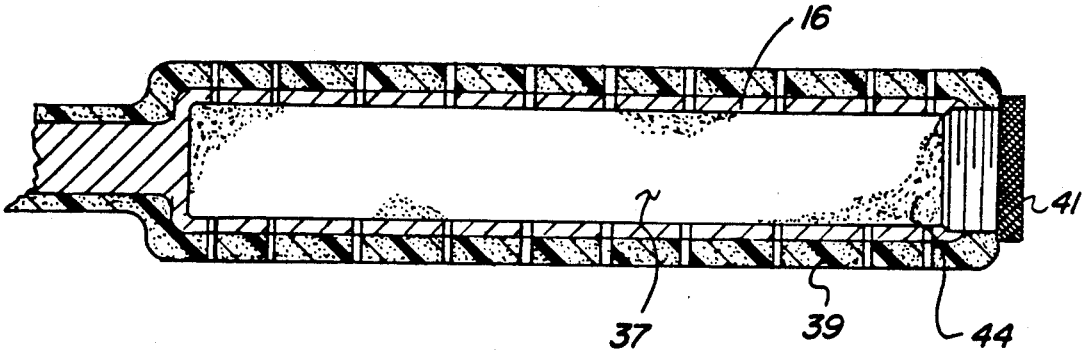
FIG. 11 is an orthographic view, taken along the lines 11—11 of FIG. 7 in the direction indicated by the arrows.
Figure 12:
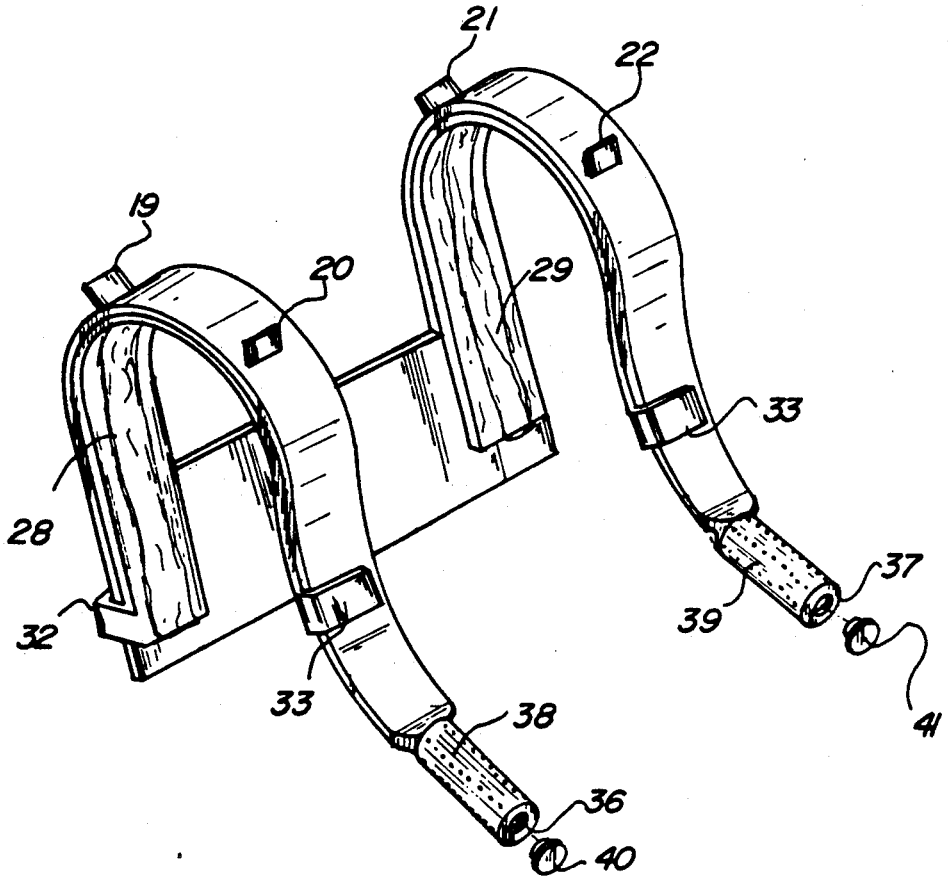
FIG. 12 is an isometric illustration of the invention illustrating the various components thereof mounted relative to the harness structure.

The FIG. 7 sets forth the apparatus to further include first and second hook and loop fastener patches 24 and 25 mounted to the support plate 11 and to the first shoulder plate 12 respectively, with the second hook and loop fastener patch positioned adjacent the first handle 15. Similarly, a third and fourth hook and loop fastener patch 26 and 27 is mounted to the first support plate 11 below the second strap 13 and to the top surface of the second shoulder plate 13 adjacent the second handle 16. In this manner, a first and second flexible cushion strap 28 and 29 is arranged for securement to the first and second shoulder plates 12 and 13 received within the first and second cavities 17 and 18. The cushion straps each include a cushion strap cavity 30, including a deformable cushion filler material 31 therewithin. Further, a first and second mounting strap 32 and 33 is orthogonally mounted to a first side of each flexible cushion strap, with the first and second mounting straps 32 and 33 including respective first and second mounting strap hook and loop fastener patches 34 and 35 that are selectively securable to the respective first and second hook and loop patches 24 and 25 and the third and fourth hook and loop fastener patches 26 and 27, in a manner as illustrated in the FIG. 12. It should be further noted that the first and second handles 15 and 16 in an organization as set forth in the FIG. 12 includes a respective first and second handle cavity 36 and 37 that is apertured that in turn is formed with a surrounding first and second apertured handled sleeve 38 and 39. The apertures of the sleeve and the apertures of the handles are each aligned relative to one another, with the first and second handles including respective first and second removable fill plugs 40 and 41 removable mounted relative to free distal ends of the handles to receive a powdered rosin 42 within the respective first and second cavities 36 and 37. In this manner, the rosin is dispensed through the handles and the handle sleeves to insure grasping of the handles and avoiding slippage of the harness structure 10. It should be noted that a suitable and anhydrous material such as powdered chalk and the like may be utilized.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A weight lifting harness apparatus, comprising, a rigid support plate adapted to be worn on the shoulders of an individual, the rigid support plate including a top edge spaced from a bottom edge, the top edge including a first end and a second end, the first end including a rigid first arcuate shoulder plate fixedly mounted thereto and the second end including a rigid second arcuate shoulder plate mounted thereto, wherein the first and second shoulder plates are arranged in a parallel coextensive relationship relative to one another extending from the support plate top edge, the first and second rigid shoulder plates including a respective first and second top surface and a respective first and second bottom surface, the respective first and second bottom surface defining a respective first and second cylindrical shoulder receiving cavity, and each shoulder receiving cavity symetrically formed formed about an axial center line arranged parallel relative to the support plate, and the first and second shoulder plates terminate in respective first and second handles, the handles project forwardly of the support plate to an orientation substantially aligned with the support plate bottom edge, and a first set of abutment flanges further comprising: a first and third abutment flange and a second set of abutment flanges further comprising: second and fourth abutment flanges, the first shoulder plate top surface includes respective first and second abutment flanges fixedly mounted to the first shoulder top surface an equal distance about the axial center line, and the second shoulder plate includes a respective third and fourth abutment flanges mounted an equal distance about the axial center line fixedly to the second shoulder plate top surface, the first set of abutment flanges being arranged to accept and position a standard weight lifting bar across the shoulder area and rearward an individuals neck and the second set of abutment flanges being arranged to accept and position a standard weight lifting bar across the shoulder area and forward an individuals neck.

2. An apparatus as set forth in claim 1 including a first hook and loop fastener patch mounted to the support plate below the first shoulder plate, and a second hook and loop fastener patch mounted to the first shoulder plate top surface adjacent the first handle, a third hook and loop fastener patch mounted to the first shoulder plate below the second shoulder plate, and a fourth hook and loop fastener patch mounted to the second shoulder plate top surface adjacent the second handle, and a first cushion strap mounted to the first shoulder plate bottom surface and secured to the first and second hook and loop fastener patch, and a second flexible cushion strap mounted within the second cavity and secured to the third and fourth hook and loop fastener patch.

3. An apparatus as set forth in claim 2 wherein the first and second cushion strap each include an elongate cavity, and each elongate cavity includes a deformable cushion filler material contained therewithin, and each first and second cushion strap includes a first and second mounting strap extending orthogonally relative to each cushion strap and the first and second mounting strap each include a further hook and loop fastener patch, wherein the first cushion strap first and second mounting strap is securable to the first and second hook and loop fastener patch, and the second cushion strap first and second mounting flap are securable to the third and fourth hook and loop fastener patch.

4. An apparatus as set forth in claim 3 wherein the first and second handles each include a matrix of handle apertures directed therethrough, and each handle includes an apertured handle sleeve including a matrix of sleeve apertures directed therethrough, wherein the sleeve apertures and the handle apertures are coaxially aligned and each handle includes a handle cavity, and each handle cavity includes an anhydrous material contained therewithin, and each free distal end of each handle includes a removable plug member selectively securable thereto to permit selective refilling of each cavity with said anhydrous material.

* * * * *